US009360200B2

(12) United States Patent
Peil et al.

(10) Patent No.: US 9,360,200 B2
(45) Date of Patent: Jun. 7, 2016

(54) COOLING DEVICE FOR CYLINDRICAL, COUPLEABLE LED MODULES

(75) Inventors: Michael Peil, Otzberg (DE); Florin Oswald, Frankfurt (DE); Harald Maiweg, Korschenbroich (DE); Bernd Willer, Moosburg/Isar (DE)

(73) Assignee: Heraeus Noblelight GmbH, Hanau (DE)

( * ) Notice: Subject to any disclaimer, the term of this patent is extended or adjusted under 35 U.S.C. 154(b) by 426 days.

(21) Appl. No.: 13/810,315

(22) PCT Filed: Jul. 5, 2011

(86) PCT No.: PCT/EP2011/003317

§ 371 (c)(1), (2), (4) Date: Jan. 15, 2013

(87) PCT Pub. No.: WO2012/007115

PCT Pub. Date: Jan. 19, 2012

(65) Prior Publication Data

US 2013/0114263 A1 May 9, 2013

(30) Foreign Application Priority Data

Jul. 16, 2010 (DE) ..... 10 2010 027 533

(51) Int. Cl.
*F21V 7/20* (2006.01)
*F21V 29/00* (2015.01)
(Continued)

(52) U.S. Cl.
CPC ..... *F21V 29/248* (2013.01); *F21K 9/30* (2013.01); *F21V 29/02* (2013.01); *F21V 29/30* (2013.01); *F21V 29/58* (2015.01); *F21Y 2101/02* (2013.01); *F21Y 2111/005* (2013.01)

(58) Field of Classification Search
CPC . F21Y 2111/005; F21V 29/004; F21V 29/22; F21V 23/06; F21V 29/02; F21V 15/011; F21V 29/006; F21V 29/2293; F21V 29/20; F21V 29/40
USPC ..... 362/249.04, 580, 218, 294, 345, 373
See application file for complete search history.

(56) References Cited

U.S. PATENT DOCUMENTS 3,869,605 A 3/1975 Davis
7,762,707 B2 * 7/2010 Kim et al. ..... 362/632
(Continued)

FOREIGN PATENT DOCUMENTS

CA 2683531 A1 5/2010
CN 201149343 Y 11/2008
(Continued)

OTHER PUBLICATIONS

Office Action issued Mar. 15, 2011 in DE Application No. 10 2010 027 533.6.
(Continued)

*Primary Examiner* — William Carter
(74) *Attorney, Agent, or Firm* — Panitch Schwarze Belisario & Nadel LLP

(57) ABSTRACT

A device and method are provided for controlling the temperature, in particular for cooling, of an LED lamp or LED modules of an LED lamp, e.g., for curing a light-cured pipe. The device includes: a fluid supply line and multiple heat exchangers connected to the supply line; multiple LEDs coupled to each heat exchanger with respect to heat transfer; and a fluid return line. The fluid supply and return lines are connected to each other in a fluid-tight manner by various combinations of L-pieces and T-pieces in or at the ends of the fluid supply and the return lines, so that the fluid flows from the LEDs in a spatially separated way and the fluid supply and return lines have at least two parallel fluid connections to each other, the heat exchangers being arranged in the fluid connections or constituting the fluid connections.

22 Claims, 5 Drawing Sheets

(51) Int. Cl.

| | |
|---|---|
| ***F21K 99/00*** | (2016.01) |
| ***F21V 29/02*** | (2006.01) |
| ***F21V 29/58*** | (2015.01) |
| *F21Y 101/02* | (2006.01) |
| *F21Y 111/00* | (2016.01) |

(56) References Cited

U.S. PATENT DOCUMENTS

| | | | | |
|---|---|---|---|---|
| 7,850,341 | B2 * | 12/2010 | Mrakovich et al. | 362/249.06 |
| 2003/0052584 | A1 * | 3/2003 | Matsui et al. | 313/24 |
| 2005/0158687 | A1 | 7/2005 | Dahm | |
| 2006/0001384 | A1 | 1/2006 | Tain et al. | |
| 2008/0123323 | A1 * | 5/2008 | Brunet | 362/84 |
| 2009/0322227 | A1 | 12/2009 | Jones et al. | |
| 2010/0051168 | A1 | 3/2010 | Moeskjaer et al. | |

FOREIGN PATENT DOCUMENTS

| | | | |
|---|---|---|---|
| EP | 1959183 | A1 | 8/2008 |
| JP | 2008-175381 | A | 7/2008 |
| WO | 2005103121 | A1 | 11/2005 |
| WO | 2008101499 | A1 | 8/2008 |

OTHER PUBLICATIONS

English translation of Search Report issued Jan. 27, 2015 in CN Application No. 201180034880.9.

English translation of Office Action issued in CN Application No. 201180034880.9.

* cited by examiner

COOLING DEVICE FOR CYLINDRICAL, COUPLEABLE LED MODULES

CROSS-REFERENCE TO RELATED APPLICATIONS

This application is a Section 371 of International Application No. PCT/EP2011/003317, filed Jul. 5, 2011, which was published in the German language on Jan. 19, 2012, under International Publication No. WO 2012/007115 A1 and the disclosure of which is incorporated herein by reference.

BACKGROUND OF THE INVENTION

The invention relates to a device for controlling the temperature, in particular for cooling, of an LED lamp or LED modules of an LED lamp, wherein the device comprises a supply line for feeding a fluid and multiple heat exchangers connected to the supply line, wherein multiple LEDs are arranged on each heat exchanger and are coupled to the heat exchanger with respect to heat transfer, so that the fluid can control the temperature, in particular cool, the LED lamp or the LED modules. The invention also relates to a method for controlling the temperature, in particular cooling, of an LED lamp or at least two LED modules of an LED lamp, using such a device and to a method for curing of a light-cured pipe using such a device.

For light-cured pipe rehabilitation, mercury vapor discharge lamps have been used successfully for approximately 20 years. These usually require no cooling. For the curing of pipe liners having small pipe diameters in the range of household connections (DN 300-DN 50, typically DN 160) there are significant restrictions for the traditionally used UV lamp technology (gas discharge lamps) with respect to the achievable minimum dimensions (diameter and length) of the lamps. The requirement of a mechanically robust holder and protective device for the bulb lamps also involves disadvantages, because these protective elements cause shadows that are significant, in particular for small pipe diameters.

For curing a light-cured pipe liner in the field of pipe rehabilitation, in particular in the range of household connections for pipes having small diameters (less than or equal to DN 300), a compact, powerful lamp is required that is cylindrical, if possible.

Due to their small geometrical dimensions and usually high optical outputs in the range of 100 W and their potentially good energy efficiency, light emitting diodes (LEDs) are suitable radiation sources for realizing small, powerful special lamps for UV curing applications, in particular in the field of trenchless pipe rehabilitation. They allow the realization of compact, efficient light sources, which can be adapted to the optical and geometrical requirements of the materials to be cured. In addition, LEDs require no wait time for achieving their full operating power, because they can be switched quickly (in the range of milliseconds or even shorter). LEDs also emit in narrow spectral ranges with half value widths of typically 10-40 nm, so that no infrared radiation is emitted by UV-LEDs and blue LEDs. Therefore, thermal dissociation of the polymers to be cross-linked can be avoided.

The combination of the usually minimal available space for the lamp of a curing device for pipe rehabilitation and the required high power densities represents a great challenge for the structure and the function of a cooling body of such an LED lamp. This applies especially when several of these LED lamps must be operated one after the other in a pipe and good movement along curves in pipes having bends is desired.

The basic use of LEDs for pipe rehabilitation is described in International patent application Publication No. WO 2005/103121 A1. The use of LEDs for the UV curing of pipe liners is also described in European patent application publication EP 1 959 183 A1, Japanese patent application publication (Kokai) JP 2008-175381 A and International patent application Publication No. WO 2008/101499 A1. LED curing systems for pipe rehabilitation are described there.

These LED lamps, which have high power densities and are used as curing devices for pipe rehabilitation, often require very efficient cooling that prevents a degraded function due to overheating of their components. Such narrow LED lamps, which have linear constructions and are used, for example, in pipes or other environments that are tightly limited in terms of space, always have the problem that there is little space for additional parts used for cooling the LED lamps or LED modules of the LED lamps. The same problem also occurs in narrow curing devices, which have linear constructions and in which the parts must be heated in the narrow space to an operating temperature in order to guarantee a reliable functioning of the parts, for example LED lasers.

For a material to be cured by light-initiated polymerization, intensities from a few $mW/cm^2$ up to a few 10 $W/cm^2$ are typically required, which explains the previously mentioned required optical outputs of the LED lamps. Because the efficiency and the service life of LEDs (ratio of optical output power and the electrical operating power) are inversely proportional to the operating temperature of the LEDs, good cooling of the LEDs is required.

To be able to control the temperature of, that is cool or heat, the parts, heat must be fed to these parts or heat must be conducted away from these parts through the narrow, hose-shaped construction. As the medium for transporting the heat energy, fluids, for example air or water, are preferred.

An operation of the heat exchangers or cooling bodies in series can be technically useful, because the supply and return of a cylindrical heat exchanger/cooling body can be easily attached to opposite ends. The fluid/medium flows through the supply into the cooling body, flows through this cooling body in the axial direction, and leaves the cooling body on the opposite end through a return connection. The supply of the next cooling body in the series is then connected to the return of the preceding cooling body and the series connection is realized in this way.

This connection, however, causes a disadvantageous, sequentially increasing advance temperature of the heat exchangers/cooling bodies that carry a flow of the cooling medium downstream and thus a lower efficiency and service life of these modules, in particular the final module that has the highest operating temperature. Increasing the flow rate of the coolant is one possibility for reducing this effect. However, this is also associated with an increased pressure drop whose compensation requires either an increase in the operating pressure, which places a higher load on the heat exchanger/cooling body, or an increase in the line cross section, which is often not possible due to the tight space relationships and the higher resulting weight of the system.

From the publication WO 2008/101499 A1, a device according to the class for controlling the temperature of an LED lamp having a linear construction or LED modules of an LED lamp is known. In the interior, the device comprises a supply line in the form of a pipe, which carries a flow of air, in order to cool LEDs arranged on the lateral surface of the pipe with the air flow. In the supply line there are openings through which the air flow can escape outwards into a pipe to be rehabilitated. A return line for returning the heated air flow is not provided.

Here, it is a disadvantage that a liquid fluid, such as water, cannot be used, because water, if it came into contact with the LEDs on the outside, could destroy these parts. Liquid fluids, however, can absorb heat significantly more efficiently than gaseous fluids. The fluid also heats up as it passes each device module, so that the temperature of the front LED modules is more strongly controlled or cooled than the rear LED modules. This cooling system involves a serial connection of the heat exchangers arranged one after the other (serial flow of fluid cooling media). This leads, for example, to service lives of different lengths for the LEDs in the different LED modules.

BRIEF SUMMARY OF THE INVENTION

The object of the invention is to solve these problems. In particular, a uniform control of the temperature of the LED lamp or the LED modules of an LED lamp should be achieved. It should also be possible to use liquid fluids for the temperature control, without possibly damaging the LEDs.

This object is achieved in that the device comprises a return line for returning the fluid, wherein the supply line and the return line are each connected to each other in a fluid-tight manner by an L-piece at one of their ends and also by at least one T-piece in the supply line and at least one T-piece in the return line, or the supply line and the return line are connected to each other in a fluid-tight manner by an L-piece at the end of the supply line that is connected to a T-piece in the return line, and an L-piece at the end of the return line that is connected to a T-piece in the supply line, or the supply line and the return line are connected to each other in a fluid-tight manner by an L-piece at the end of the supply line that is connected to a T-piece in the return line and an L-piece at the end of the return line that is connected to a T-piece in the supply line, and also by at least one T-piece in the supply line and at least one T-piece in the return line, so that the fluid flows spatially separated from the LEDs and so that the supply line and the return line have at least two fluid connections connected in parallel to each other, wherein the heat exchangers are arranged in the fluid connections or the heat exchangers are the fluid connections.

Here, it can be provided that the heat exchangers connected in parallel can be shiftable, compressible, and/or movable relative to each other.

It can be further provided that the device has a modular construction and comprises LED modules, wherein one LED module comprises two L-pieces and at least one LED module comprises two T-pieces, or two LED modules comprise an L-piece and one T-piece and/or at least one additional LED module comprises two T-pieces, and wherein the LED modules also comprise a fluid connection with a heat exchanger, wherein the LED modules are connected to each other, in particular in a detachable manner, by supply line parts and return line parts, so that additional LED modules can be easily replaced, removed, and also installed.

Here, it can be provided that the supply line parts and return line parts, which connect the LED modules to each other are flexible, expandable, and/or compressible, in particular are flexible plastic hoses and/or corrugated boots, preferably with springs, so that the device can be pulled along an arc-shaped path in a pipe.

One improvement of the device provides that the LED modules are arranged in series one after the other geometrically in a line.

It can also be provided that the return line is arranged parallel to the supply line.

It can be further provided that the fluid in the return line flows in the opposite direction of that in the supply line.

It can also be provided that the device comprises the LED lamp or the LED modules.

Here, it can be further provided that the LED modules have the same construction, in particular they are identical.

One improvement of the device provides that the LED lamp or the LED module is a curing device, in particular a light source for pipe rehabilitation, wherein the fluid does not come in contact with the material to be cured.

It can also be provided that each LED module comprises at least one substrate having at least one LED, preferably at least one high-power LED, which are arranged preferably in a ring-like shape, such that the LEDs emit radiation outwardly, preferably in all directions of a plane perpendicular to the linear structure of the LED lamp or the LED modules.

Here, it can be provided that multiple LEDs are mounted as chip-on-board (COB) on a substrate.

The use of chip-on-board (COB) technology allows the realization of high intensity light sources having homogeneous emission patterns and having cylindrical geometry and having high optical outputs in the range of a few watts to several 100 watts. Through the possibility to use LEDs having higher powers, a quicker curing of the pipes to be cured, and thus an acceleration of the curing process, is achieved.

One improvement of the invention provides that each LED module comprises one connection unit on which supply lines are connected, which comprise the supply line, the return line, and electrical cables that are at least partially connected to the LEDs.

Another construction according to the invention provides that each LED module is enclosed by a housing, in particular a glass, stainless steel, or plastic housing.

Another alternative construction of the invention provides that the device comprises a supply unit, which comprises a fluid regulator for controlling the flow rate and/or the temperature of the fluid through the supply line and/or the return line.

Here, it can be provided that the supply unit comprises an LED controller for controlling the voltage applied to the LEDs.

In addition, it can be provided that the device and/or the LED modules comprise at least one sensor, preferably a temperature sensor, an illumination strength sensor, a current sensor, and/or a voltage sensor.

Here, it can be advantageous if the sensor or sensors are connected to the fluid regulator and/or to the LED controller in the supply unit.

It can also be provided here that the electrical cables contact the supply line to at least one sensor and/or a drive device and connect with the supply unit.

Another construction of the invention provides that each heat exchanger and/or each LED module has a cylindrical or ring-shaped structure having a circular or polygonal cross section.

Here, it can be provided that at least two adjacent openings are provided for the supply and the return of the fluid on the inside and/or the side surfaces of the heat exchanger, which are separated from each other by a partition wall in the heat exchangers, such that the fluid flows through the heat exchanger essentially within its entire extent.

Further, it can be provided here that the supply line and the return line extend through the opening of the cylindrical or ring-shaped LED modules and/or the cylindrical or ring-shaped heat exchangers.

In general, it is advantageous for the devices according to the invention if the supply line parts and return line parts, which connect the modules to each other, are flexible, in particular flexible plastic hoses, so that the device can be pulled along an arc-shaped path in a pipe.

It can also be provided that, at the contact surfaces to the LEDs or to the substrate, the heat exchangers are made at least in some areas from a material with good heat conducting properties, in particular from a metal, preferably copper, aluminum, brass, or steel, and/or from a ceramic, preferably $Al_2O_3$ or AlN.

One improvement of the invention provides that the fluid is a gas, in particular compressed air or nitrogen, or a liquid, in particular water.

It can also be provided that each LED module is designed for an optical power between 1 watt and 1000 watts.

It can be further provided that the LED lamp at least partially, in particular the LED modules, can be cooled and/or heated by the fluid.

It can also be provided that the supply line, the return line, the T-pieces, the L-pieces, and the heat exchangers are connected to each other in a fluid-tight manner.

One advantageous improvement provides that shutters are arranged or can be mounted in or on the fluid connections.

It can also be provided that the cross section is adjusted to the fluid connections or shutters are arranged in or on the fluid connections, such that all of the heat exchangers are flowed through with a similar volume flow of the fluid, so that the volume flows through the heat exchangers differ by a maximum factor of 3, preferably by a maximum factor of 2.

The object is also achieved by a method for controlling the temperature, in particular cooling, of an LED lamp or at least two LED modules of an LED lamp using such a device, wherein a fluid is fed through the supply line to the at least two heat exchangers, a heat transfer takes place there with the LED lamp or the LED modules, and the fluid is then returned through the return line.

Here, it can be provided that the fluid flows out of the return line into a supply unit, is cooled or heated there, and is then fed back into the supply line, in order to regulate the temperature of the fluid in the supply line, in particular as a function of the signals of at least one sensor, and/or the flow rate of the fluid is regulated, in particular as a function of the signals of at least one sensor.

In particular, the object is achieved for a method for curing a light-cured pipe, in that such a device for cooling a curing device, in particular a light source for pipe rehabilitation, is inserted into the pipe together with the curing device, and then the pipe is cured by the light from the LEDs, while the device and the curing device are moved through the pipe, and the curing device or the LED modules of the curing device are cooled by the device, in particular using a method as already described.

Finally, it can be provided that the flow rate of the fluid, the temperature of the fluid, the radiant power of the LEDs, and/or the velocity of the device in the pipe is controlled, in particular as a function of the measured values of a sensor, in particular a temperature sensor, an illumination strength sensor, a current sensor, and/or a voltage sensor.

The invention is thus based on the surprising finding that even heat exchangers arranged geometrically in series can be connected in parallel in terms of the temperature-controlling fluid, and therefore an equally strong temperature-controlling effect can be achieved at the different heat exchangers. All of the device modules, which are connected to the heat exchangers, are cooled or heated to an equally strong degree by this device. In this way, homogeneous temperature conditions are achieved in the regions of the device to be controlled.

In contrast to the known series connection of cooling bodies/heat exchangers for LED lamps for pipe rehabilitation, the present invention solves the resulting problems by arranging the cylindrical cooling bodies/heat exchangers geometrically in series, but connecting these parts in parallel in the cooling circuit, wherein each of the individual cooling bodies carries a flow in the peripheral direction of the extent. This is achieved in that the supply line and the return line of the cooling body/heat exchanger are arranged in the interior of the cylinder, and these are each connected by a T-piece or an L-piece to a common supply line or common return line for all of the cooling bodies/heat exchangers. These T-pieces and L-pieces can be realized either as individual components, whose branch connections are each connected to the supply line or the return line of the cooling body/heat exchanger. Likewise, its temperature distribution function can be integrated directly in the cooling body/heat exchanger, so that the cooling body/heat exchanger has two feed connections and two return connections on each end.

The parallel connection (coupling) of the heat exchangers allows the same supply temperature to the individual heat exchangers, even though these are arranged geometrically in series (for example one after the other in a pipe). In a fitted system (line resistance, flow resistance of the heat exchangers and connection ports are customized), an equal volume flow can be set through all of the heat exchangers, and thus the same temperature conditions can be realized for all of the LED modules (for example the same cooling conditions for all of the LED modules).

Then, the heat exchanger of the LED lamp farthest away from a rear cooler also has the same temperature as the closest, which is different from heat exchangers in a series connection. Through the parallel connection, the same operating and output parameters that are dependent on temperature: efficiency, service life, emission wavelength, and rated electrical input, can be realized for all of the coupled LED modules.

In addition, a parallel connection causes a lower pressure drop in the overall system than a series connection. This is relevant, in particular, if the flow resistances in the lines are small compared with those of the heat exchangers.

Another advantage is achieved in that the length of the individual LED modules can be reduced, which improves the ability of the device to move along curved paths.

As a light source for pipe rehabilitation in the field of household connections, according to the invention an LED lamp has been found that allows a homogeneous irradiation of the inner wall of a pipe having small, round cross sections of approximately 15 cm and higher radiant powers of several 100 $mW/cm^2$ up to a few $W/cm^2$. In addition, the LED lamp can be moved along curved paths and pulled in 45° and 90° bends.

The necessary power density for the homogeneous illumination of the inner wall of pipes under consideration of the small diameter and the required ability to move along curved paths is achieved by over three-hundred LEDs on a cooling body acting as a heat exchanger having a diameter of approximately half the pipe diameter (approximately 8 cm) and a length of approximately one fourth of the diameter (approximately 3.5 cm).

To achieve the required radiation dose for pulling speeds of a few centimeters to a few tens of centimeters per minute (greater than 30 cm/min), the modules should be coupled to each other as flexibly as possible.

The high optical outputs in the range of a few watts to several 100 watts associated with this arrangement require compact and efficient cooling bodies, due to the necessary compact arrangement of the LED lamps and the typical efficiency of LEDs (typically in the range from 1% to 50%, normally 10% to 30%).

Because LEDs are assembled on flat substrates, the substrates are arranged on an elongated, possibly cylindrical body having polygonal cross section, preferably a triangular, quadrangular, pentagonal, hexagonal, or octagonal cross section.

Because at most several LED modules are required for achieving the target dose, the LED modules can be coupled flexibly one behind the other.

For maintaining the efficiency and for improved operation with additional temperature-dependent parameters, a cooling system was developed, which allows the parallel operation of LED modules located one behind the other. Here, the supply and return of each heat exchanger is connected by a T-branch or an L-branch to a common supply line or common return line for all of the heat exchangers, which lines are guided centrally through the heat exchangers.

Therefore, in a customized system, each heat exchanger can be operated at the same supply temperature with a comparable cooling power or heating power, and thus an equal efficiency and service life are maintained throughout the LED modules located spatially one after the other.

The individual heat exchangers carry a flow preferably in the peripheral direction. The fluid, which can be a gas, for example compressed air or nitrogen, for low power requirements, but is otherwise a liquid, and for higher powers a medium having high heat capacity, for example water, here flows close to the outer surface along the periphery of the heat exchanger, so that the substrates having the LEDs are cooled effectively.

By the parallel connection of the heat exchangers arranged spatially one after the other, the flow resistance of the fluid/cooling medium is also kept low in the system, so that, for the same volume flow of the fluid, supply lines having smaller diameters can be used than in a series temperature-control system.

A series cooling system can indeed have a similar overall cooling power, but then there is a higher temperature difference of the heat exchangers relative to each other. This is the case, in particular, when the flow resistances of the heat exchanger are comparable or larger than those of the lines that connect the heat exchangers to each other. In the reverse case, an adaption of the flow resistances to the individual heat exchangers for regulating a uniform volume flow can be necessary, which can be realized, for example, by the use of shutters.

The integration of the connection function in the center of the heat exchangers also allows the heat exchangers to have a short length, which improves the ability of the system to move along a curved path.

A device according to embodiments of the invention thus has a whole series of advantages.

A parallel connection for the supply of a cooling or heating medium to heat exchangers located one after the other allows, in a customized system, the operation of all of the heat exchangers under the same conditions, in particular at the same supply temperature and same volume flow of the fluid through the individual heat exchangers. For the latter, in the case of small supply lines and low flow resistances, measures could be required on the heat exchanger for adapting the volume flow rates, for example the mentioned regulating shutters. This case, however, represents a limiting case that usually can be avoided. In contrast to a space-saving serial supply, the more complicated parallel supply avoids a sequential rise or drop in the supply temperature in the direction of the heat exchanger spatially farthest away from the supply to the system. This property is relevant, in particular, for the cooling of LEDs that have strongly temperature-dependent properties and whose efficiency, emission wavelength, service life, and operating voltage can be adversely affected.

For the same line cross section, comparable connection technology, and identical heat exchangers, the flow resistance of the parallel system is lower than that of the series system. Accordingly, either for the same operating pressure, connection lines having smaller nominal widths can be used for realizing the same volume flow, or for the same nominal widths, the connection lines can achieve higher volume flows and thus better cooling or heating powers for the same operating pressure. For adjusting the volume flows in the limiting case of high line resistances and low flow resistances in the heat exchangers, the use of different shutters for adjustments is then also possible.

The heat exchangers can be constructed so that the fluid flows past in a circular flow and almost covering the entire surface, close to the outer surface, so that efficient temperature control is achieved.

The line in the heat exchanger can be macroscopic or microscopic (for example micro-channel cooling).

The possibility for increasing the efficiency of the cooling power can be used for increasing the efficiency of the LED lamp and/or for increasing the optical output limit of the system, because the LED parameters are dependent on the temperature.

By the paired switching of supply and return connections to the heat exchangers of every second LED module, the circulating direction of the fluid can be set in opposite directions from module to module. Possible gradients that can appear in the heating of the cooling medium or in the cooling of the heating medium between the supply and return and can cause, for example, a gradient in the optical output of LEDs along the periphery of a cylindrical LED module, can be distributed in an alternating pattern, so that possible effects of these gradients are lessened or even prevented during pulling processes.

The arrangement of the connection elements in the interior of the cylindrical heat exchangers makes possible a short length of the LED module and thus a better ability to move along curved paths than if the connection elements were positioned on the ends of the heat exchangers.

Positioning the connection elements in the interior of the heat exchangers protects them from mechanical effects that could cause leaks. The connection mechanism of the connections can vary: T- or L-pieces connected by hoses and hose clamps, couplings that can be screwed on with integrated T- and L-shaped features or coupling elements that can be plugged in.

The use of coupling elements that can be plugged in allows the construction of a modular LED system, in which every module is replaceable, in which the supply media (current and cooling medium) can be connected and disconnected by a locking or non-locking coupling mechanism (possibly can be disconnected without dripping). The connection can be disconnected and connected on both sides of the module, so that it is completely replaceable without having to disassemble the entire system in sequence (starting from one side).

Several LED modules can be coupled to each other by rigid or by elastic, expandable, and/or compressible connections. A possibly smaller line diameter of the supply lines for the temperature control can have positive effects on the weight of the system and also on the flexibility of the system (ability to move along curved paths).

Several systems coupled spatially one behind the other can also be used for the uniform heating or uniform cooling of cylindrical bodies. Wherever the present text refers to a cooling circuit, cooling output, cooling body, or cooling medium, according to the invention this could also be a heating circuit, heating output, heating body, or heating medium, respectively. With a heating circuit, pipes to be cured can also be cured thermally by contact heating or thermal radiation. Likewise, components, for example lasers, can also be heated to a certain temperature, in order to achieve a constant output and an exact wavelength in the temperature-controlled laser.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
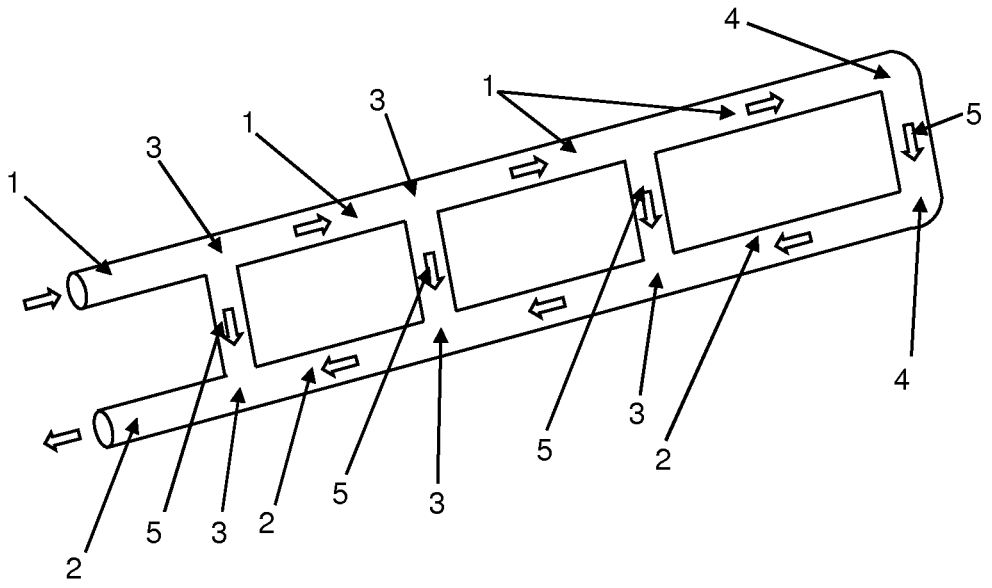
FIG. 1 is a schematic view of a device according to an embodiment of the invention for controlling the temperature of a device.

FIG. 1 shows a schematic view of a device according to an embodiment of the invention for controlling the temperature of an LED lamp or LED modules of an LED lamp and sketches a cooling or heating circuit. The device comprises a supply line (1) and a return line (2) that are both divided into different sub-areas. The supply line (1) and the return line (2) are formed by pipes. Between each of the sub-areas of the supply line (1) and the return line (2) there are three T-pieces (3). At the end of the supply line (1) and at the beginning of the return line (2) there is an L-piece (4). The T-pieces (3) and the L-pieces (4) are likewise formed by pipes. Between every two adjacent T-pieces (3) of the supply line (1) and the return line (2) and the two L-pieces (4) there are heat exchangers (5) that have tubular constructions.

All of the pipe pieces (1, 2, 3, 4, 5), that is the supply line parts (1), the return line parts (2), the T-pieces (3), the L-pieces (4), and the heat exchangers (5), can be connected to each other in a fluid-tight manner by various methods. The pipes can be either connected rigidly to each other, for example welded, connected to each other by press fittings, or the pipes can be connected to each other in a detachable way, for example one inserted into the other or attached to each other by coupling pieces or hose clamps or also flanged onto each other.

As the material from which the pipe pieces (1, 2, 3, 4, 5) can be produced, metals, ceramics, or plastics can be used.

It is especially preferred that the supply line parts (1) and the return line parts (2) are made from flexible hoses or corrugated boots, while the T-pieces (3) and the L-pieces (4) are made from a rigid material, such as rigid plastic, a ceramic, or metal or a combination of these materials, and the heat exchangers are made from metal, preferably copper, and/or a ceramic having a high heat conductivity value.

One of the modules of the device comprises the two L-pieces (4) and a heat exchanger (5). All of the other modules of the device each comprise two T-pieces (3) and a heat exchanger (5). If the modules are connected in a detachable way to the supply line parts (1) and the return line parts (2), an additional module can easily be joined to another supply line part (1) and a return line part (2).

The LED lamp to be temperature-controlled or the LED modules of the LED lamp to be temperature-controlled can be connected to each heat exchanger (5), so that connections having good heat conduction can be formed between the heat exchangers (5) and the LED lamp or the LED modules. The outer dimensions of the heat exchangers (5) are adapted to the geometry of the LED lamp or the LED modules.

The size of the device, in particular the size of the heat exchangers (5), the spacing of the T-pieces (3) and L-pieces (4), and the diameters of the supply line parts (1) and the return line parts (2) are adapted to the size of the LED lamp or the LED modules and to their purposes.

A fluid for controlling the temperature of the heat exchangers (5) and thus the LED lamp or the LED modules is guided through the pipes (1, 2, 3, 4, 5) that are connected to each other in a fluid-tight manner. The outlined arrows show the direction of flow of the fluid in the pipes (1, 2, 3, 4, 5). This fluid is a gas, for example compressed air or nitrogen, or a liquid, for example water, which transports the thermal energy away from the heat exchangers (5) or to the heat exchangers (5).

The return line (2) can also lead away from the supply in the opposite direction. Then, the return line (2) would be mounted reversed, that is the L-piece of the return line (2) would be mounted on the first T-piece (in the direction of flow of the fluid) of the supply line (1) and the L-piece of the supply line (1) would be mounted on the T-piece of the return line (2) that is connected, in the embodiment shown in FIG. 1, to the first T-piece of the supply line (1). The direction of flow of the fluid would then no longer reverse from the supply line (1) to the return line (2).

Figure 2:
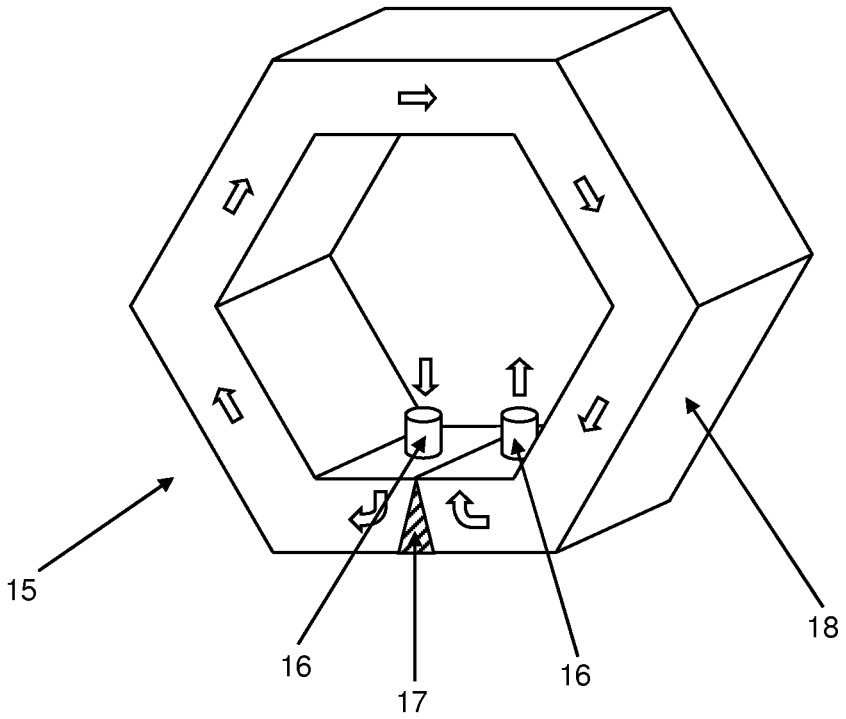
FIG. 2 is a schematic, perspective view of a heat exchanger of a module of a device according to an embodiment of the invention.

FIG. 2 shows a ring-shaped heat exchanger (15) having a cross section of a six-sided polygon (hexagon). The heat exchanger (15) comprises two connection ports (16) through which the fluid can be guided through the heat exchanger (15), as indicated by the outlined arrows. The connection port (16) of the supply is located at the left, that of the return at the right. A partitioning wall in the form of a wedge (17) separates the supply from the return in the heat exchanger (15). The fluid therefore flows around the axis of the heat exchanger (15) clockwise in a circular motion, as indicated by the outlined arrows. The flow is close to the outer surface (18) of the heat exchanger (15), whereby a good heat transfer is achieved.

The inner ring of the heat exchanger (15) offers sufficient space for connecting T-pieces or L-pieces and for passing through cables and hoses (such as a supply line and a return line).

Figure 3:
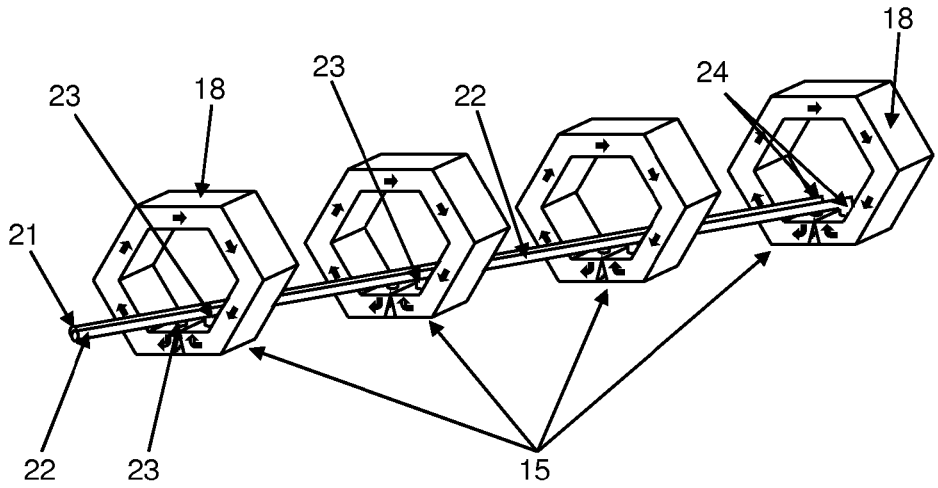
FIG. 3 is a schematic, perspective view of a device according to an embodiment of the invention comprising four heat exchangers according to FIG. 2.

FIG. 3 shows, in a perspective view, the schematic structure of an arrangement of four heat exchangers (15) connected in such a way to form a device according to the invention, together with the supply line (21) and the return line (22), as well as the T-pieces (23) and the two L-pieces (24). The T-pieces (23) are arranged in the supply line (21) and the return line (22), while the two L-pieces (24) are each arranged on one of the ends of the supply line (21) and the return line (22). The supply line (21) and the return line (22) are connected to each other in a fluid-tight manner by the heat exchangers (15).

The two connection ports (16) are connected with T-pieces or L-pieces to the common supply line (21) (supply) or return line (22) (return) of a temperature-control system, such that several such heat exchangers (15), which can be arranged spatially one behind the other, can be supplied in parallel.

FIG. 3 shows, as an example, the structure of a cooling system for a high-power LED lamp, which is based on a parallel connection for the cooling medium supply and whose heat exchangers (15) or LED modules acting as cooling bodies are located one behind the other. Up to the last cooling body (15) (top right at the edge of the FIG.), the supply lines (21) or return lines (22) of the cooling bodies (15) are connected by T-pieces (23) to a common supply line (21) or return line/supply line (22). The last cooling body (15) is connected to this supply line by L-pieces (24). Such connectors (23, 24) can be individual connection elements, which are connected, for example, by hoses and hose clamps to the cooling bodies (15). They could also be pluggable couplings, which seal by O-rings, or else lines integrated directly in the cooling bodies (15) with the same function, which are contacted from the ends (for example by plug-in connectors). The common main lines (21, 22) can be rigid or flexible, for example polyamide hoses.

If LEDs (not shown) are mounted on the outer surfaces (18), a cylindrical LED lamp is then realized with which, by suitable selection of the LEDs, a pipe can be cured or rehabilitated. The current supply lines for the LEDs can also be guided through the ring opening of the heat exchangers (15).

Each heat exchanger (15), which is equipped on all of its outer sides with LEDs, is then an LED module. The coupling of the LED modules with cables for connecting the LED modules to a current supply produces an LED lamp.

The LED lamp is then, in the sense of the present invention, for example, a light source for pipe rehabilitation in the field of household connections.

Figure 4:
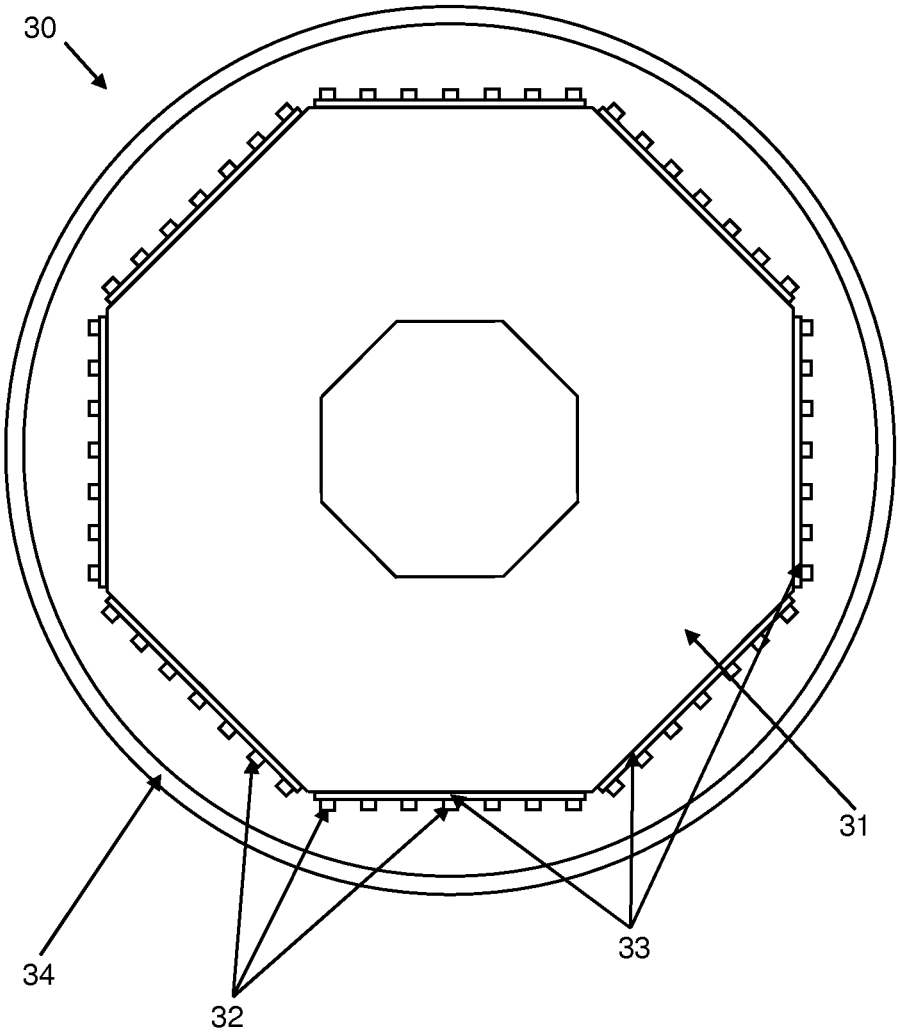
FIG. 4 is a schematic cross-sectional view of a device according to an embodiment of the invention having a plurality of LEDs.

FIG. 4 shows an LED module (30) of such an LED lamp in a schematic cross-sectional view. On an 8-sided cooling body (31) that here functions as a heat exchanger, a plurality of LEDs (32) is mounted using chip-on-board technology (COB technology). Here, several LEDs (32) are mounted on a substrate (33), wherein a substrate (33) is arranged on each of the eight sides of the cooling body (31). The LED module (30) is surrounded with a circular housing (34) in the form of protective glass, which is connected rigidly to the LEDs (32) or the cooling body (31).

The geometry of the LED module (30) is designed for a uniform illumination of a cylindrical hollow body, so that the inner walls of this hollow body are homogeneously irradiated by the LED module (30), even if the hollow body has a slightly larger diameter than that of the LED module (30). Such a light source is required, for example, in pipe rehabilitation. For applications having strict requirements for the optical output power, in which, due to the typical efficiencies of the LEDs (32) in the range of 1% to 50%, considerable amounts of heat must be dissipated through the cooling body (31), liquid cooling media are required as the fluid flowing through the cooling bodies (31). In the present case, this flow is circular around the axis of the cooling body (31).

The circulating flow is close to the surface of the cooling body (31), so that the substrates (33) mounted on this body can be cooled effectively.

The shown cross section thus shows the cross section of an LED module (30) of an LED lamp comprising several LED modules (30) together with a heat exchanger module (31) of the cooling device, that is an LED module (30) and a heat exchanger (31) in the sense of the present invention. The LED lamp can also comprise electrical connections (not shown), which are required for operating the LEDs (32), and a controller (not shown), which supplies the LEDs (32) with power and optionally controls the drive of the system. The device according to the invention can be just the cooling system or also the cooling system together with the LED lamp.

Figure 5:
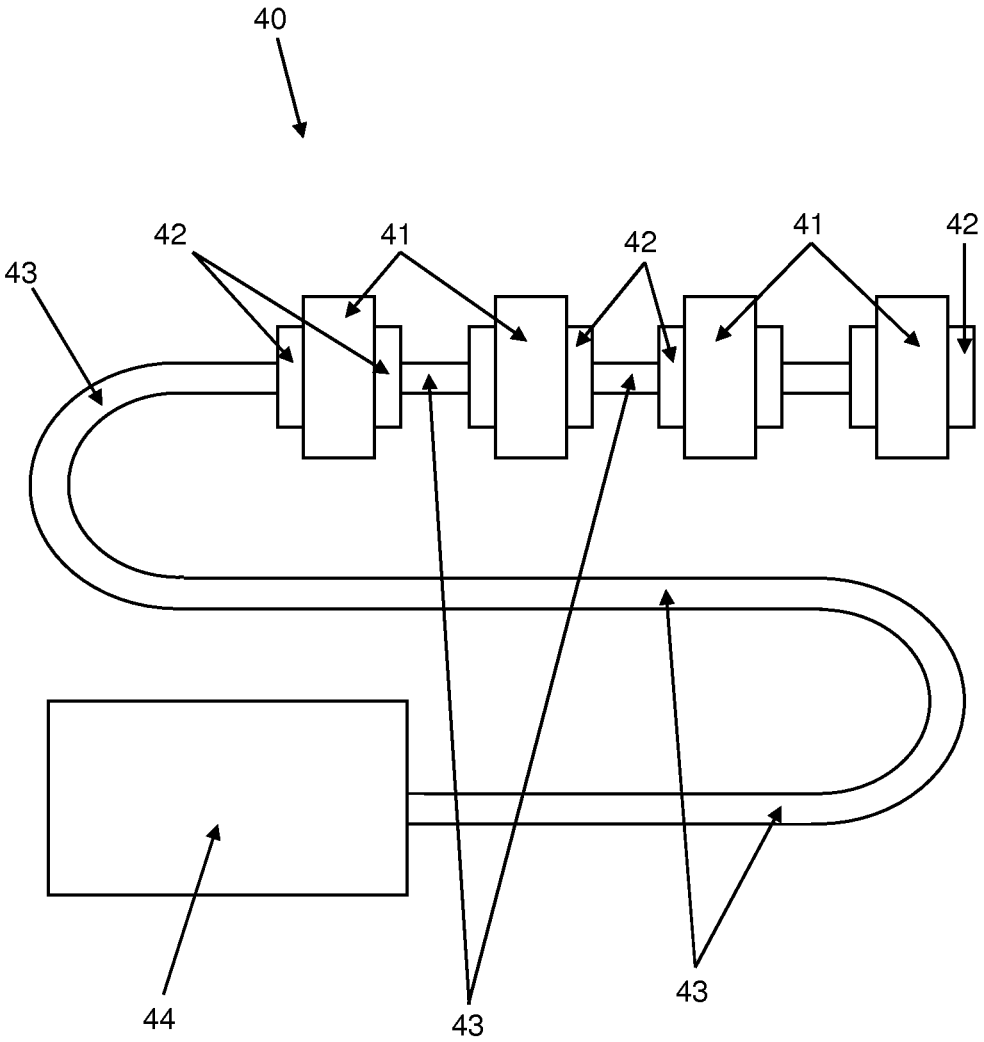
FIG. 5 is a schematic representation of a device according to an embodiment of the invention having a device whose temperature is to be controlled.

FIG. 5 shows schematically and as an example a modular LED structure. The shown LED lamp (40) consists of four cylindrical LED modules (41), whose geometry is adapted to the purpose of the application, having connection units (42) at which supply lines (43) are connected to the LED modules (41). An LED module (41) comprises at least one substrate having one or more LEDs that are mounted on a cooling body. As the cooling medium for cooling the LEDs, gases or liquids are used. The cooling body can be produced in different ways (for example milling, stamping, cutting, folding, eutectic bonding of metals, etc.). The LED modules (41) are enclosed in a housing (glass cylinder, stainless steel or plastic housing, etc.).

Furthermore, sensors (not shown), such as temperature, illuminance, current, or voltage sensors, can be integrated in the LED modules (41), wherein these sensors report the operating status to a control and supply unit (44), allowing the operating conditions of the LED lamp (40) to be adapted to the current state. The connection units (42) allow a modular expansion having additional LED modules (41), as well as exchangeability for maintenance purposes. From the viewpoint of the cooling circuit, the parallel supply of the LED modules (41) with the cooling medium is advantageous, in particular also in the sense of expandability, because all cooling bodies are always supplied with the same advance temperature. The LED modules (41) can be coupled by rigid or flexible connection elements, so that they are arranged in series with each other either rigidly or flexibly (by a protective hose, metal springs, corrugated boots, or the like). In this way, the LED lamp (40) can be pulled along an arc-shaped path in a pipe. A flexible or rigid supply line (43) connects the LED modules (41) to the control and supply unit (44), which includes the electrical supply and the supply with the cooling medium, as well as a control and regulation unit for the targeted control of relevant operating parameters.

The devices according to the invention are particularly suitable for use in pipe rehabilitation in the field of household connections (DN50-DN300, typically DN120-DN160). In addition, in this field, the use of the technology is also conceivable for larger pipe diameters, because the system allows high outputs and the geometric size can be scaled up. Other fields of application could also be down pipes for rain gutters, chimneys, or the like. An LED lamp could also be developed to rehabilitate side connections that are sealed by the light curing of so-called (liner) caps. Other applications are also conceivable, for example, the illumination of tubular spaces or hollow bodies.

The possibility of realizing a correspondingly constructed heating system is also possible. With this heating system, flexibly coupled heating elements (heating medium flowing through heating bodies) can heat the walls of cylindrical bodies. This can be realized either through radiant flux (thermal radiation) or through direct thermal conduction between the heating bodies and cylindrical bodies where they are in contact.

The features of the invention disclosed in the preceding description, as well as in the claims, Figures, and embodiments, can also be essential either alone or in any arbitrary combination for the realization of the invention in its various constructions.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. An LED lamp having a device for cooling LED modules of the LED lamp, the cooling device comprising:

a plurality of LED modules, each LED module comprising a plurality of LEDs arranged on at least one substrate and coupled to a heat exchanger with regard to heat transfer, the at least one substrate of one LED module being separate from that of another LED module;

a common supply line for feeding a fluid to each heat exchanger of the plurality of LED modules, such that the fluid cools each LED module; and a common return line for returning the fluid from each heat exchanger of the plurality of LED modules, wherein the common supply line and the common return line are connected to each other in a fluid-tight manner by one of the following combinations of a T-piece and an L-piece:

by an L-piece at one of their ends and by at least one T-piece in the common supply line and by at least one T-piece in the common return line, or by an L-piece at one end of the common supply line connected to a T-piece in the common return line and by an L-piece at one end of the common return line connected to a T-piece in the common supply line, or by an L-piece at one end of the common supply line connected to a T-piece in the common return line, by an L-piece at one end of the common return line connected to a T-piece in the common supply line, and by at least one T-piece in the common supply line and at least one T-piece in the common return line, such that the fluid flows in a spatially separated way from the LEDs, wherein the T-piece and the L-piece are separate components from the common supply line and the common return line, wherein the common supply line and the common return line have at least two fluid connections connected in parallel to each other, wherein the heat exchangers are arranged in the fluid connections or the heat exchangers are the fluid connections, and wherein the plurality of LED modules are coupled to each other by flexible connection elements of the common supply line and the common return line, such that the plurality of LED modules are flexibly arranged in series with one another and are movable relative to each other, so that the LED lamp can be pulled along an arc-shaped path in a pipe.

2. The LED lamp according to claim 1, wherein the device has a modular construction and comprises the plurality of LED modules, wherein one LED module comprises two L-pieces and at least one LED module comprises two T-pieces, or two LED modules comprise one L-piece and one T-piece and/or at least one additional LED module comprises two T-pieces, and wherein the plurality of LED modules also comprise a fluid connection to a heat exchanger, wherein the plurality of LED modules are detachably connected to each other by supply line parts and return line parts, such that additional LED modules can be easily exchanged, removed, and installed.

3. The LED lamp according to claim 2, wherein the supply line parts and return line parts, which connect the plurality of LED modules to each other, are flexible, expandable, and/or compressible.

4. The LED lamp according to claim 1, wherein the plurality of LED modules are arranged in series one after another geometrically in a line.

5. The LED lamp according to claim 1, wherein the common return line is arranged parallel to the common supply line.

6. The LED lamp according to claim 1, wherein the fluid in the common return line flows in an opposite direction to the fluid in the common supply line.

7. The LED lamp according to claim 1, wherein the LED lamp is a curing device for pipes, wherein the fluid does not come in contact with the material to be cured.

8. The LED lamp according to claim 1, wherein each LED module comprises at least one high-power LED, arranged in a ring shape, such that the plurality of LEDs emit radiation outwardly in all direction of a plane perpendicular to the linear structure of the LED lamp or the plurality of LED modules.

9. The LED lamp according to claim 8, wherein the plurality of LEDs are mounted on the substrate as a chip-on-board (COB).

10. The LED lamp according to claim 1, wherein the device comprises a supply unit comprising a fluid regulator for controlling flow rate and/or temperature of the fluid through the common supply line and/or the common return line.

11. The LED lamp according to claim 10, wherein the supply unit comprises an LED controller for controlling a voltage applied to the plurality of LEDs.

12. The LED lamp according to claim 1, wherein the device and/or the plurality of LED modules comprise at least one sensor selected from a temperature sensor, an illuminance sensor, a current sensor, and a voltage sensor.

13. The LED lamp according to claim 1, wherein each heat exchanger and/or each LED module has a ring-shaped structure having a polygonal cross section.

14. The LED lamp according to claim 13, wherein at least two adjacent openings are provided for supply and return of the fluid to an inside and/or to side surfaces of the heat exchangers, which are separated from each other by a partition wall in the heat exchangers, such that the fluid flows through the heat exchangers essentially in their total extent.

15. The LED lamp according to claim 14, wherein the common supply line and the common return line extend through the opening of the cylindrical or ring-shaped LED modules and/or the cylindrical or ring-shaped heat exchangers.

16. The LED lamp according to claim 1, wherein the heat exchangers are at least partially made of a metal, selected from copper, aluminum, brass, and steel, and/or from a ceramic selected from $Al_2O_3$ or AIN, at contact surfaces to the LEDs.

17. The LED lamp according to claim 1, wherein the fluid is a gas selected from compressed air or nitrogen, or a liquid comprising water.

18. The LED lamp according to claim 1, wherein a cross section of the fluid connections is adjusted, such that all of the heat exchangers carry a similar volume flow of the fluid, so that the volume flows through the heat exchangers differ maximally by a factor of two to three.

19. A method for cooling an LED lamp according to claim 1, the method comprising feeding a fluid through the common supply line to at least two heat exchangers, carrying out heat transfer with the plurality of LED modules, and returning the fluid through the common return line.

20. The method according to claim 19, further comprising flowing the fluid from the common return line into a supply unit, cooling the fluid in the supply unit, and feeding the cooled fluid back into the common supply line, in order to control a temperature of the fluid in the common supply line.

21. A method for curing a light-cured pipe using an LED lamp according to claim 1 as a curing device, the method comprising inserting the LED lamp into the pipe and curing the pipe by light from the plurality of LEDs, while the curing device is moved through the pipe and the plurality of LED modules of the curing device are cooled by the cooling device.

22. The LED lamp according to claim 1, wherein each heat exchanger and/or each LED module has a cylindrical structure having a circular cross section.

* * * * *